US006131337A

United States Patent [19]

Machida

[11] Patent Number: 6,131,337

[45] Date of Patent: Oct. 17, 2000

[54] VEHICLE DOOR CLOSING APPARATUS

[75] Inventor: Toshio Machida, Chiryu, Japan

[73] Assignee: Aisin Seiki Kabushiki Kaisha, Kariya, Japan

[21] Appl. No.: 09/296,565

[22] Filed: Apr. 22, 1999

[30] Foreign Application Priority Data

Apr. 22, 1998 [JP] Japan ..... 10-111604
May 13, 1998 [JP] Japan ..... 10-130128

[51] Int. Cl.[7] ..... E05F 15/00

[52] U.S. Cl. ..... 49/280; 49/287; 292/201

[58] Field of Search ..... 49/280, 287, 360; 292/199, 201, 336.3, 216

[56] References Cited

U.S. PATENT DOCUMENTS

| | | | |
|---|---|---|---|
| 4,093,289 | 6/1978 | Inabayashi et al. | 292/201 |
| 4,861,089 | 8/1989 | Compeau et al. | 49/280 |
| 4,934,646 | 6/1990 | Yamada | 292/201 |
| 4,988,135 | 1/1991 | Ottino | 292/201 |
| 5,004,077 | 4/1991 | Carlson et al. | 49/360 |
| 5,443,292 | 8/1995 | Shimada et al. | 292/201 |
| 5,537,848 | 7/1996 | Grzanka et al. | 292/201 |
| 5,551,190 | 9/1996 | Yamagishi et al. | 49/280 |
| 5,642,636 | 7/1997 | Mitsui | 292/201 |
| 5,769,468 | 6/1998 | Armbruster | 292/201 |
| 5,802,894 | 9/1998 | Jahrsetz et al. | 292/201 |
| 5,836,639 | 11/1998 | Kleefeldt et al. | 49/360 |
| 5,921,612 | 7/1999 | Mizuki et al. | 49/360 |

FOREIGN PATENT DOCUMENTS 5-59856 3/1999 Japan .

*Primary Examiner*—Daniel P. Stodola
*Assistant Examiner*—Curtis A Cohen
*Attorney, Agent, or Firm*—Burns, Doane, Swecker & Mathis, LLP

[57] ABSTRACT

A vehicle door closing apparatus includes a latch mechanism adapted to be mounted on a side of a vehicle door to hold the vehicle door in a half closed state and a completely closed state through engagement with a striker, and a closing mechanism that operates the latch mechanism for bringing the vehicle door in the half closed state into the completely closed state. The closing mechanism includes a pivotable active lever connected to a drive source, a passive lever engaged with the active lever and capable of being engaged with the latch mechanism, and a cancel lever connected to an operation source and capable of being engaged with and disengaged from the passive lever above a pivoting center of the active lever for effecting engagement and disengagement between the passive lever and the active lever.

14 Claims, 10 Drawing Sheets

VEHICLE DOOR CLOSING APPARATUS

This application is based on and claims priority under 35 U.S.C. § 119 with respect to Japanese Application No. 10(1998)-111604 filed on Apr. 22, 1998 and Japanese Application No. 10(1998)-130128 filed on May 13, 1998, the entire content of both of which is incorporated herein by reference.

FIELD OF THE INVENTION

The present invention generally relates to a door closing apparatus. More particularly, the present invention pertains to a vehicle door closing apparatus having a closing mechanism for bringing a vehicle door in a half closed state into a completely closed state upon operation of a latch mechanism.

BACKGROUND OF THE INVENTION

A known vehicle door closing apparatus is disclosed in JP-A-5-59856. This door closing apparatus includes a striker, a latch mechanism and a closer mechanism. The striker is installed on the vehicle body and the latch mechanism is installed on the side of the vehicle door for holding the vehicle door in a half closed state and a completely closed state by engaging the striker. The closing mechanism is coupled to the latch mechanism for bringing the vehicle door in the half closed state into the completely closed state through operation of the latch mechanism.

The closing mechanism includes a pivotable active lever, a passive lever and a cancel lever. The active lever is connected to a drive source. The passive lever is engaged with the active lever and is capable of being engaged with the latch mechanism. The cancel lever is connected to an operation source capable of effecting engagement and disengagement between the passive lever and the active lever.

In addition, the passive lever is formed with an opening in a deformed shape having a first opening and a second opening. A slide pin inserted into the opening in the passive lever is supported by the cancel lever and the active lever via a tong hole. The slide pin slides along the long hole of the active lever by operating to pivot the cancel lever to thereby move between the first opening and the second opening of the passive lever, by which the active lever is engaged with and disengaged from the passive lever.

However, according to this known apparatus, the active lever is engaged with and disengaged from the passive lever by the slide pin. When the active lever and the passive lever are pivoted, that is in the closing operation, the slide pin moves in a diametrical direction along the long hole of the cancel lever along with the passive lever and the active lever. Accordingly, when the cancel lever is operated to pivot in the closing operation, depending on the operational timing thereof, the distance from the pivoting center of the cancel lever to the slide pin, that is a lever ratio of the cancel lever, is changed. As a result, the operation of the cancel lever can be heavy or difficult.

In light of the foregoing, a need exists for a vehicle door closing apparatus that is not as susceptible to the foregoing disadvantages and drawbacks.

It would be desirable to provide a vehicle door closing apparatus having an improved operational performance.

It would also be desirable to provide a vehicle door closing apparatus in which the operation of the cancel lever does not become heavy or difficult during operation.

Also, it would be desirable to provide a vehicle door closing apparatus in which the restriction of the relative pivoting of the passive lever can be carried out with a small force.

It would be further desirable to provide a vehicle door closing apparatus in which twisting of the cancel lever during the opening operation does not occur so that excellent operational performance can be achieved in the opening operation.

It would be further desirable to provide a vehicle door closing apparatus in which the space occupied by the closing mechanism at the inside of the vehicle door is reduced so that the space for moving the sliding glass up and down can be provided without the need for enlarging the thickness of the vehicle door.

SUMMARY OF THE INVENTION

According to the present invention, the vehicle door closing apparatus includes a striker that is adapted to be mounted on a side of a vehicle body, a latch mechanism for being mounted on a side of a vehicle door to hold the vehicle door in a half closed state and a completely closed state through engagement with the striker, and a closing mechanism that operates the latch mechanism for bringing the vehicle door in the half closed state into the completely closed state. The closing mechanism includes a pivotable active lever connected to a drive source, a passive lever engaged with the active lever and capable of being engaged with the latch mechanism, and a cancel lever connected to an operation source and capable of being engaged with and disengaged from the passive lever above a pivoting center of the active lever for effecting engagement and disengagement between the passive lever and the active lever.

BRIEF DESCRIPTION OF THE DRAWING FIGURES

The foregoing and additional features of the present invention will become more apparent from the following detailed description considered with reference to the accompanying drawing figures in which like elements are designated by like reference numerals and wherein.

DETAILED DESCRIPTION OF THE INVENTION

Figure 1:
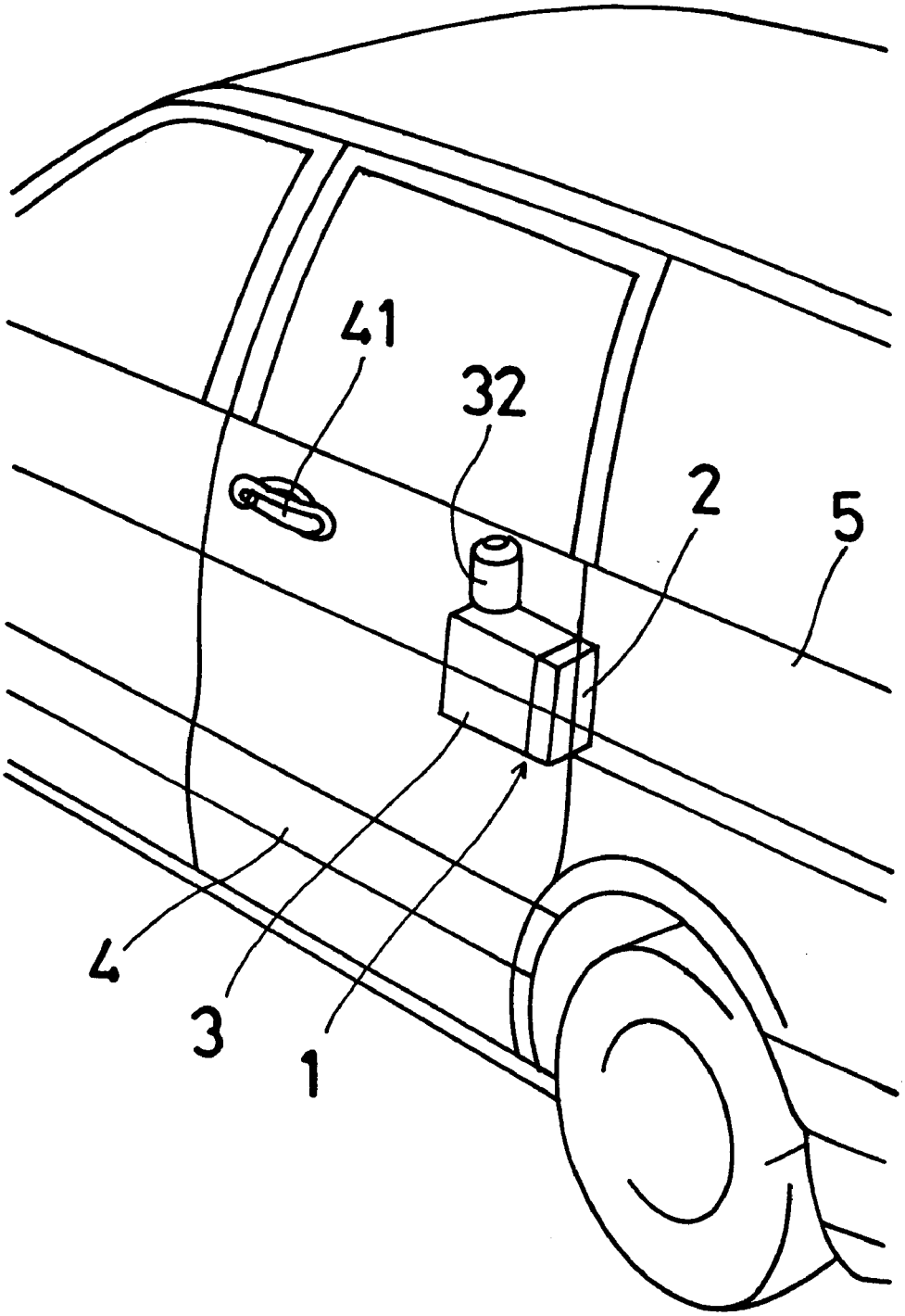
FIG. 1 is a perspective view of a portion of a vehicle outfitted with a vehicle door closing apparatus according to the present invention.

As shown in FIG. 1, the door closing apparatus 1 according to the present invention includes a latch mechanism 2 and a closing mechanism 3, and is arranged at the inside of a sliding door 4 that is opened and closed by sliding operation. The door closing apparatus holds the sliding door 4 in a closed state by engaging a striker 51 (see FIG. 2) installed on the vehicle body 5 with a latch 21 (see FIG. 2) of the latch mechanism 2.

Figure 4:
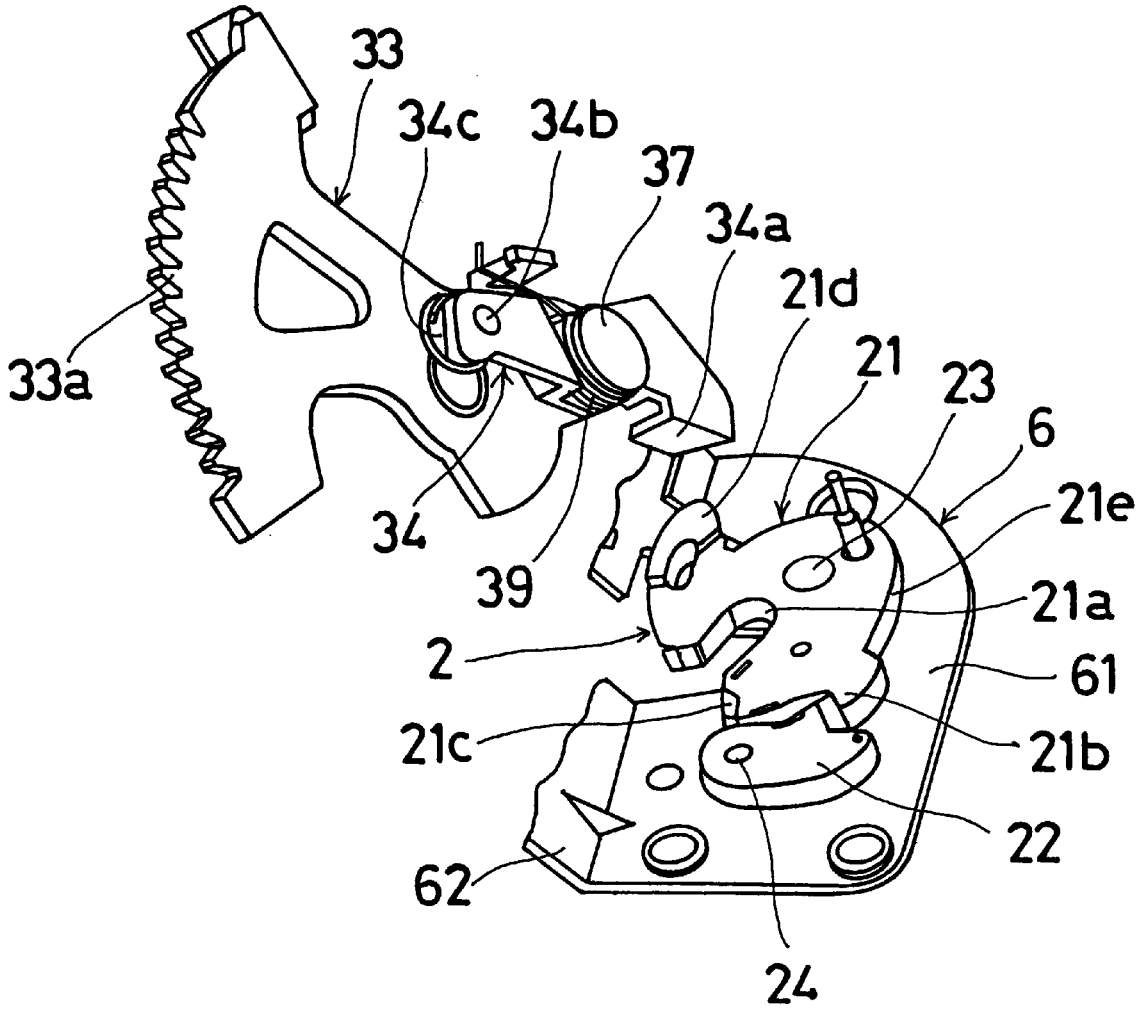
FIG. 4 is a perspective view of the latch mechanism and closing mechanism of the vehicle door closer apparatus according to the present invention.
Figure 6:
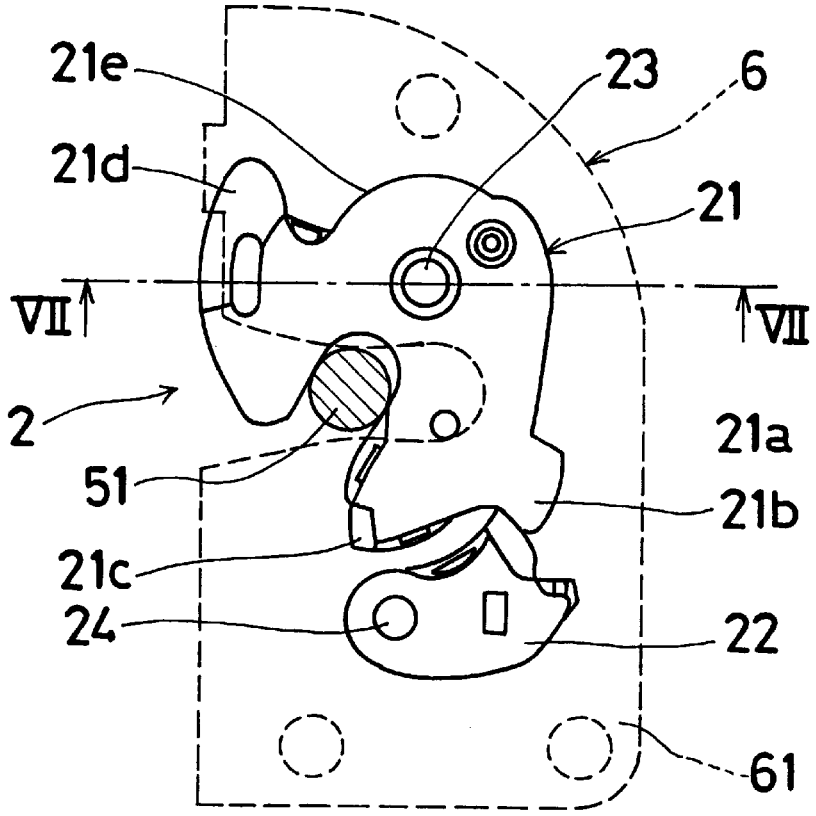
FIG. 6 is a front view of the latch mechanism of the vehicle door closing apparatus according to the present invention.
Figure 7:
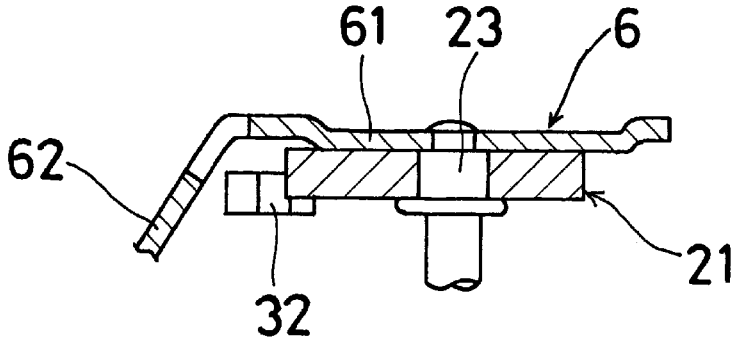
FIG. 7 is a cross-sectional view of the closing mechanism taken along the section line VII—VII in FIG. 6.

As shown in FIGS. 4, 6 and 7, the latch mechanism 2 is fixed to the inside of the sliding door 4 by way of a base plate 6. The latch mechanism 2 includes the latch 21 and a pole 22 contained in a body 25 (see FIG. 2) that is made of resin and fixed to the base plate 6.

Figure 3:
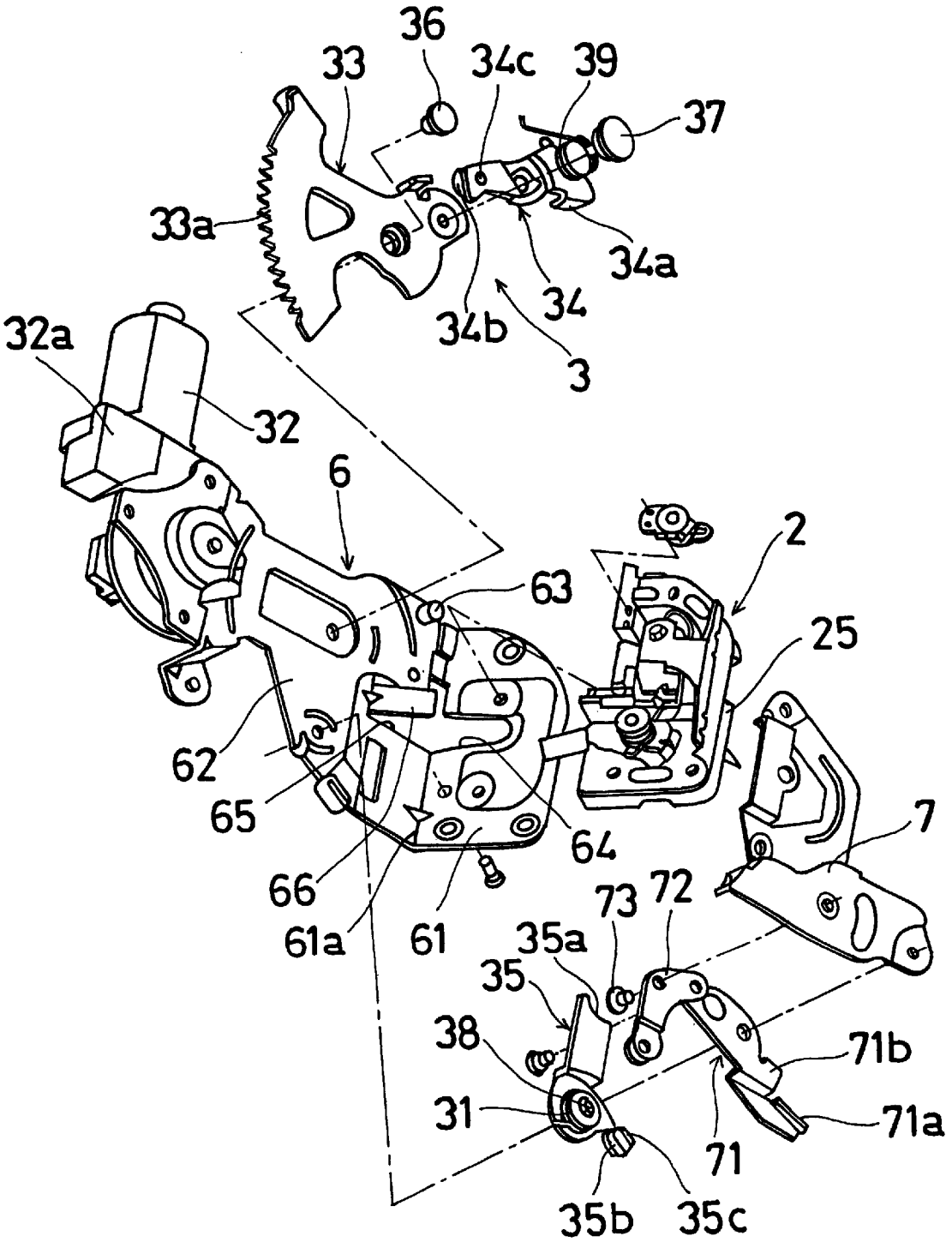
FIG. 3 is an exploded perspective view of the vehicle door closing apparatus shown in FIG. 2.

The base plate 6 is formed by bending a sheet or plate into a generally L-shaped form to provide a horizontal wall 61 located along the end face of the sliding door 4 and a vertical wall 62 located along the inner face of a compartment. As seen in FIG. 3, the horizontal wall 61 and the vertical wall 62 are formed with generally U-shaped notches 64, 65 that are opposed to each other. The notches 64, 65 open to the edge 61*a* between the horizontal wall 61 and the vertical wall 62 so that the two notches open to each other and form an elongated notch. The striker 51 is adapted to advance into the U-shaped notches 64, 65 upon closing the sliding door 4. Further, the U-shaped notch 65 in the vertical wall 62 is integrally formed with a flange wall 66 that extends obliquely from a bottom edge of the U-shaped notch 65 toward the bottom edge of the other U-shaped notch 64. The flange wall 66 is adapted to be brought into contact with the striker 51 during closing operation of the sliding door 4 to guide the striker 51 such that the striker 51 firmly advances into the U-shaped notches 64, 65.

The latch 21 is rotatably supported on the horizontal wall 61 of the base plate 6 by a pin 23. The latch 21 is provided with a generally U-shaped groove 21*a* that opens to the outer peripheral surface 21*e* of the latch 21. The groove 21*a* is adapted to be engaged with and disengaged from the striker 51 as the striker 51 advances into the notches 64, 65. The groove 21*a* thus overlaps the U-shaped notch 64 in the horizontal wall 61 of the base plate 6. The latch 21 is also formed with a first engaging claw 21*b* and a second engaging claw 21*c* which project outwardly from the outer peripheral surface 21*e* of the latch 21. The first and second engaging claws 21*b*, 21*c* are adapted to be engaged with and disengaged from the pole 22.

Figure 2:
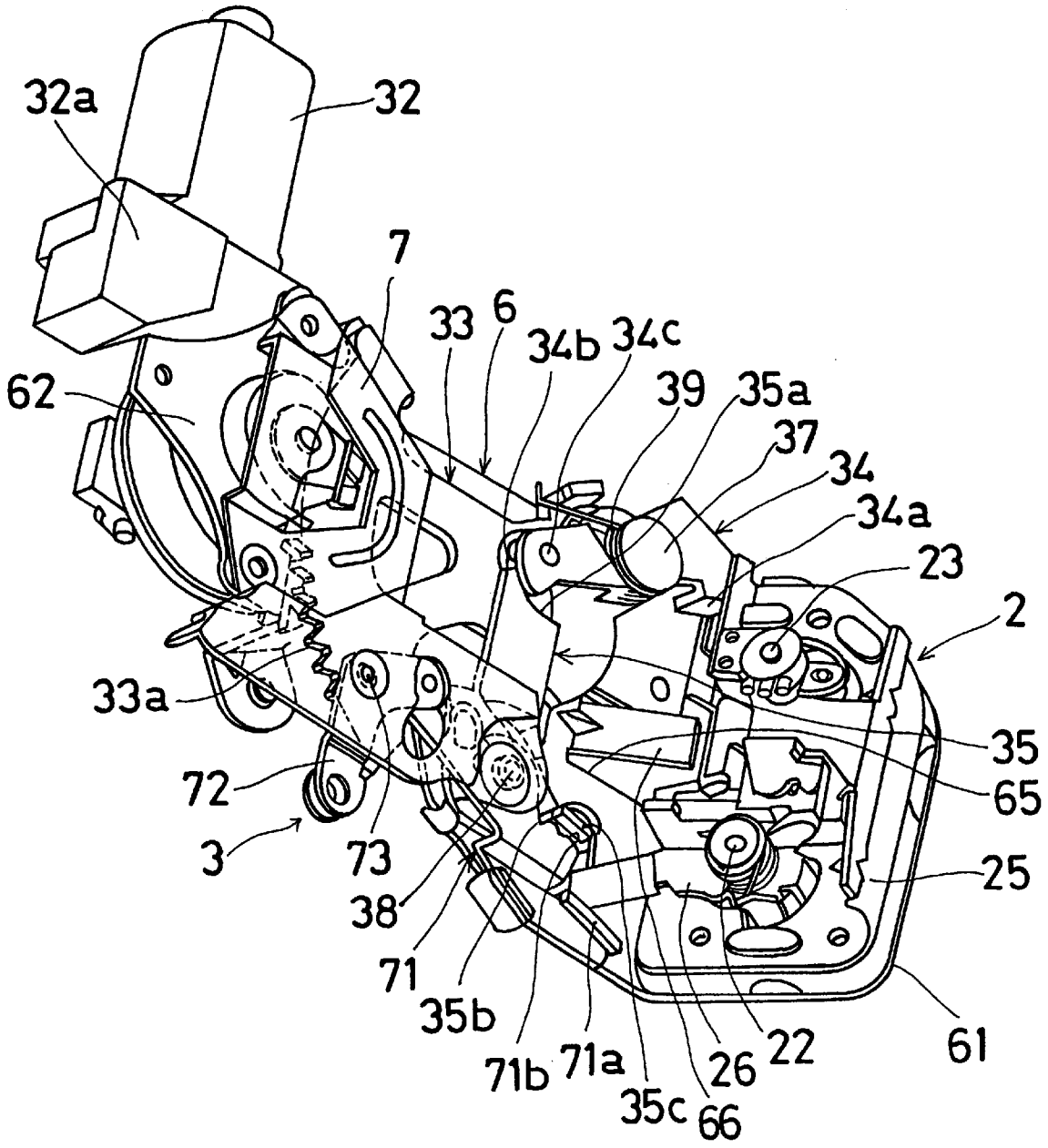
FIG. 2 is a perspective view of the vehicle door closing apparatus according to the present invention.

The pole 22 is rotatably supported on the horizontal wall 61 of the base plate 6 by a pin 24. The pole 22 is adapted to be engaged with and disengaged from the first and second engaging claws 21*b*, 21*c* of the latch 21 by rotational movement of the pole 22. Further, the pole 22 is connected to an open lever 26 that is pivotally supported by the pin 24 on the body 25 as illustrated in FIG. 2 and According to the construction described above, a half latched state of the latch mechanism 2 which is shown in FIG. 6 is set by the engagement of the first engaging claw 21*b* with the pole 22 and with the striker 51 being engaged by the latch 21 to thereby hold the sliding door 2 in the half closed state. Further, a full latched state of the latch mechanism 2 is set by the engagement of the second engaging claw 21*c* with the pole 22 and with the striker 51 being engaged by the latch 21 to thereby hold the sliding door 2 in a completely closed state.

As shown in FIG. 4, the outer peripheral surface 21*e* of the latch 21 is formed with an outwardly projecting engaging projection portion 21*d* which is adapted to engage the closing mechanism 3. The engaging projection portion 21*d* is arranged relative to the outer peripheral surface 26*e* of the latch 21 such that the engaging projection portion 21*d* approaches the vertical wall 62 of the base plate 6 in the half latched state and is disposed on the inner side of the compartment in the sliding door 4.

As shown in FIGS. 2–5 and 1, the closing mechanism 3 includes a motor 32, an active lever 33, a passive lever 34 and a cancel lever 35. The motor 32 is fixed to the vertical wall 62 of the bas e plate 6 via a housing 32*a* that houses a reduction gear mechanism. The motor 32 is connected to an output pinion gear 32*b* arranged on the side of the surface of the base plate 6 via the reduction gear mechanism that is housed in the housing 32*a*.

Figure 5:
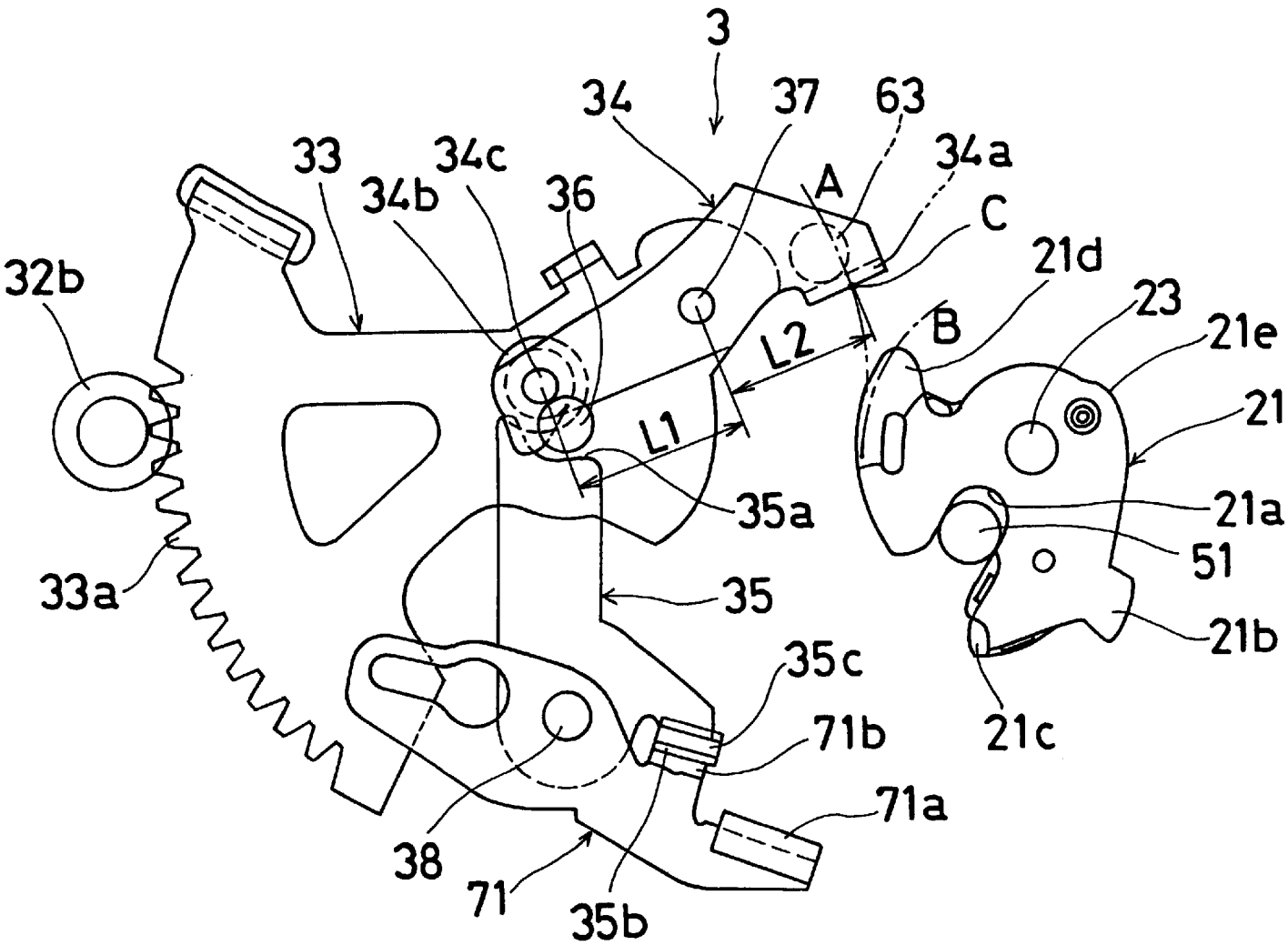
FIG. 5 is a front view of the closing mechanism of the vehicle door closing apparatus according to the present invention.

The active lever 33 is arranged on the side surface of the vertical wall 62 of the base plate 6 and is pivotally supported on the base plate 6 by a pin 36. The active lever 33 is formed with a sector gear portion 33*a* possessing the shape of a circular arc rack which is in meshing engagement with the output pinion gear 32*b* of the motor 32 as shown in FIG. 5.

The passive lever 34 is supported on the active lever 33 and thus on plate member 6 by a pin 37 so that the passive lever 34 can pivot relative to the active lever 33. An engaging arm portion 34*a* is formed at one end of the passive lever 34. The engaging arm portion 34*a* extends such that a pivoting locus A of the engaging arm portion 34*a* centering on the pin 37 (as mentioned later, the pivoting locus A of the engaging arm portion 34*a* when the passive lever 34 is moved integrally with pivoting of the active lever 33) intersects a pivoting locus B of the engaging projection portion 21*d* of the latch 21, with the engaging arm portion 34*a* being brought into contact with the engaging projection portion 21*d* at a point where the pivoting loci A and B intersect or cross each other. The engagement between the passive lever 34 of the closing mechanism 3 and the latch 21 of the latch mechanism 2 is established by bringing the engaging arm portion 34*a* and the engaging projection portion 21*d* into contact with each other. Further, an engaging pin 34*c* having a roller 34*b* is positioned on the other end of the passive lever 34. The engaging pin 34*c* is arranged to pass above the pivoting center of the active lever 33 (i.e., the pin 36) by relative pivoting movement of the passive lever 34.

The cancel lever 35 is pivotally supported on a sub base plate 7 that is fixed to the vertical wall 61 of the base plate 6 by a pin 38. The front end of the cancel lever 35 is formed with an engaging face 35*a* which is adapted to engage the engaging pin 34*c* of the passive lever 34 that is disposed on the pivoting center of the active lever 33 via the roller 34*b*. The engagement of the engaging face 35*a* of the cancel lever 35 with the engaging pin 34*c* of the passive lever 34 restricts the pivoting movement of the passive lever 34 relative to the active lever 33. Further, by pivoting the cancel lever 35, engagement between the engaging face 35*a* of the cancel lever 35 and the engaging pin 34*c* of the passive lever 34 is released, and so pivoting movement of the passive lever 34 relative to the active lever 33 is permitted. Thus, engagement and disengagement between the active lever 33 and the passive lever 34 occurs. The cancel lever 35 is also provided with a contact flange 35*c* having an elastic member 35*b*.

The pivoting center of the passive lever 34, (i.e., the position of the pin 37) is set such that a span L1 from the pin 37 to the engaging pin 34*c* is larger than the span L2 from the pin 37 to a point C at which the engaging projection portion 21*d* and the engaging arm portion 34*a* are brought into contact with each other. Thus, in engaging the engaging pin 34*c* of the passive lever 34 with the engaging face 35*a* of the cancel lever 35, that is in restricting the relative pivoting of the passive lever 34, a load on the cancel lever 35 caused by a reaction force when the engaging arm portion 34*a* of the passive lever 34 is brought into contact with the engaging projection portion 21*d* of the latch 21 is reduced. Thus, the relative pivoting of the passive lever 35 can be restricted by a small force.

A spring 39 is arranged around the pin 37. One end of the spring 39 is locked to the active lever 33 and the other end of the spring 39 is locked to the passive lever 34. Further, a spring 31 is arranged around the pin 38. One end of the spring 31 is locked to the base plate 7 and other end is locked to the cancel lever 35. By receiving the urging forces of the springs 39, 31, the passive lever 34 and the cancel lever 35 are respectively urged to pivot in a direction which causes engagement of the engaging pin 34*c* and the engaging face 35*a* (i.e., the passive lever 34 is urged in the counterclockwise direction in FIG. 5 and the cancel lever 35 is urged in the clockwise direction in FIG. 5).

The vertical wall 62 of the base plate 6 is provided with a stopper pin 63 which can be contacted by the engaging arm portion 34*a* of the passive lever 34. By bringing the stopper pin 63 in contact with the engaging arm portion 34*a* of the passive lever 35, the relative pivoting movement of the passive lever 35 by the urging force of the spring 39 (relative pivoting in the counterclockwise direction of FIG. 5) is restricted.

A connecting lever 71 is pivotally supported on the sub base plate 7 by the pin 38 so that the pivot axes of the connecting lever 71 and the cancel lever 35 are coaxial. The connecting lever 71 is provided with an engaging leg portion 71*a*, and the connecting lever 71 extends on a pivoting locus to a front end of the open lever 26 to operate in a way that pivots the open lever 26 through engagement by the engaging leg portion 71*a*. The connecting lever 71 also possesses an engaging arm portion 71*b*. The engaging arm portion 71*b* of the connecting lever 71 is brought into contact with the contact flange 35*c* of the cancel lever 35, via the elastic member 35*b*, to pivot the cancel lever 35 against the urging force of the spring 31, and to restrict pivoting of the cancel lever 35 in the clockwise direction of FIG. 5 by the urging force of the spring 31. By restricting the pivoting of the cancel lever 35 by bringing the contact flange 35*c* of the cancel lever 35 into contact with the engaging arm portion 71*b* of the connecting lever 71, the engaging face 35*a* of the cancel lever 35 is arranged at a position proximate to the pin 36.

The connecting lever 71 is also connected to an outside handle 41 installed on the outer side of the compartment of the sliding door 4 via a connecting link 72 that is pivotally supported on the sub base plate 7 by a pin 73. The connecting lever 71 is operated to pivot by operating the outside handle 41. The urging force of the spring 39 is weaker than the urging force of the spring 31, and the urging force of the spring 31 is not so strong as to operate to pivot the connecting lever 71. The sub base plate 7 supports the pin 38 to sandwich the cancel lever 35 between the sub base plate 7 and the vertical wall 62 of the base plate 6, and functions to prevent detachment of the cancel lever 35.

Having described the features associated with the vehicle door closing apparatus, the operation of the apparatus is as follows. When the sliding door 4 is brought into an open state, the striker 51 and the latch 21 are disengaged. Also, the first and second engaging claws 21*b*, 21*c* of the latch 21 and the pole 22 are brought into a disengaged state. That is, the latch mechanism 2 is brought into an unlatched state. At this time, the engaging projection portion 21*d* of the latch 21 is at a position deviated or spaced from the pivoting locus A of the engaging arm portion 34*a* of the passive lever 34.

Figure 8:
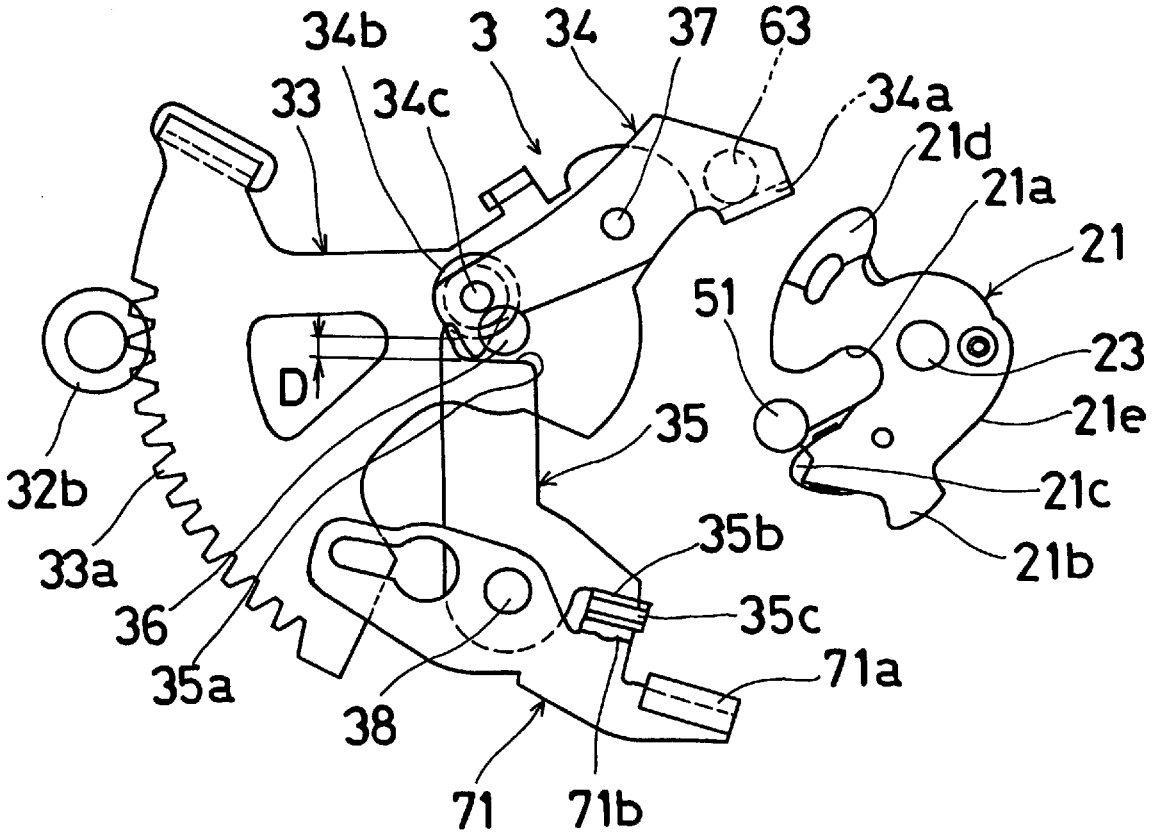
FIG. 8 is a front view of the closing mechanism shown in FIG. 5 illustrating one operational position of the closing mechanism.

As shown in FIG. 8, the active lever 33 is disposed at an initial position and the passive lever 34 is brought into a state in which the stopper pin 63 and the engaging arm portion 34*a* are brought into contact with each other and in which the relative pivoting by the urging force of the spring 39 is restricted. Further, the cancel lever 35 is brought into a state in which the contact flange 35*c* and the engaging arm portion 71*b* of the connecting lever 71 are brought into contact with each other and in which pivoting by the urging force of the spring 31 is restricted. In these positions of the passive lever 34 and the cancel level 35, the engaging pin 34*c* of the passive lever 34 is deviated or separated from above the pin 36 and is opposed to the engaging face 35*a* of the cancel lever 35 arranged at a position proximate to the pin 36 with a predetermined clearance D between the pin 36 and the engaging face 35*a*. Further, the engaging arm portion 34*a* of the passive lever 34 is at a position deviated or spaced from the pivoting locus B of the engaging projection portion 21*d* of the latch 21.

In this state, when the sliding door 4 is operated to close, the striker 51 advances into the U-shaped groove 21*a* of the latch 21 to thereby rotate the latch 21 in the counterclockwise direction of FIG. 8. The first engaging claw 21*b* of the latch 21 engages the pole 22 and the latch mechanism 2 is brought into the half latched state. The sliding door 4 is thus held in the half closed state. At this time, the engaging projection portion 21*d* of the latch 21 is disposed on the pivoting locus A of the engaging arm portion 34*a* of the passive lever 34.

Figure 9:
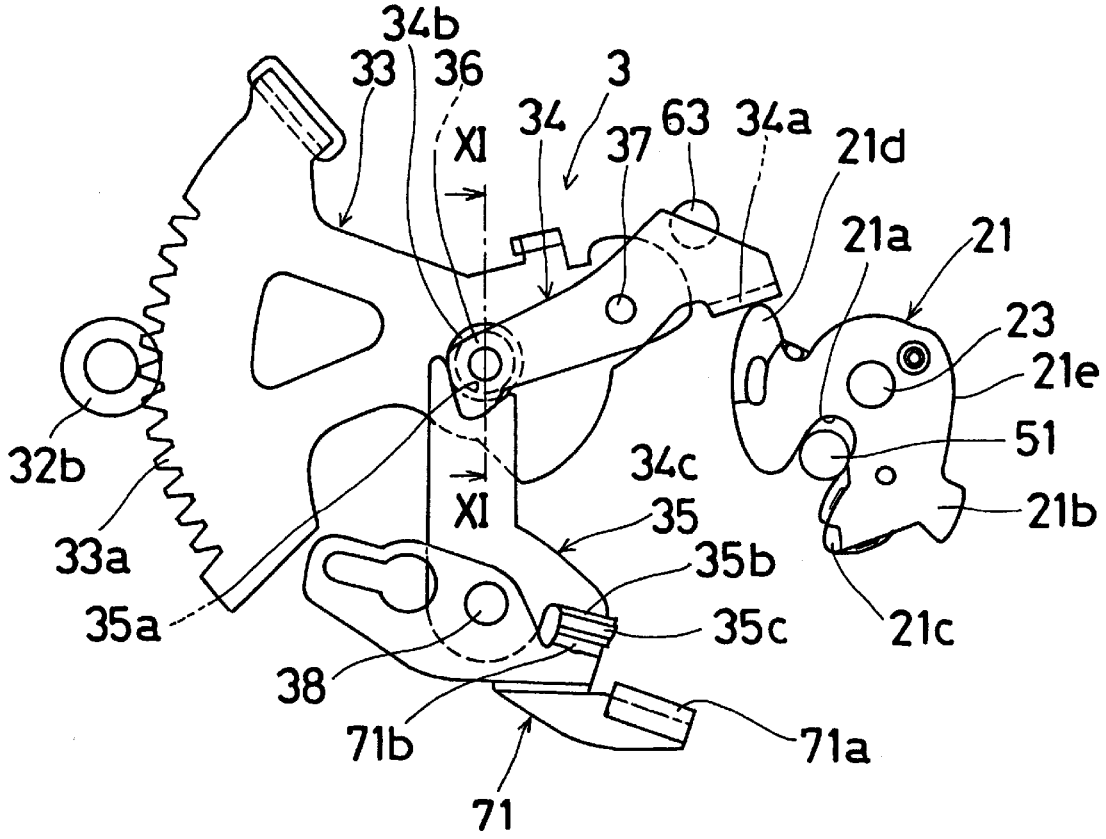
FIG. 9 is a front view of the closing mechanism shown in FIG. 5 illustrating another operational position of the closing mechanism.

In response to the operation of the latch mechanism 2, the motor 32 of the closing mechanism 3 is driven and as shown by FIG. 9, the active lever 33 is pivoted in the clockwise direction of FIG. 9 by virtue of the output pinion gear 32*b* and the sector gear portion 33*a* being in meshing engagement with each other. At this time, the passive lever 34 is supported on the active lever 33 and so the passive lever 34 is moved about the pin 37 integrally with pivoting of the active lever 33 to release the contact between the stopper pin 63 and the engaging arm portion 34*a*. However, the passive lever 34 is relatively pivoted in the counterclockwise direction of FIG. 9 by receiving the urging force of the spring 39 to maintain the contact between the stopper pin 63 and the engaging arm portion 34*a*. Thus, the engaging pin 34*c* is disposed above the pin 36 to engage with the engaging face 35*a* of the cancel lever 35. By the engagement of the engaging pin 34*c* with the engaging face 35*a*, the relative pivoting of the passive lever 34 is restricted. Thereafter, with further pivoting of the active lever 33, the passive lever 34 is integrally moved or pivoted in a manner centering on the pin 37 and the engaging arm portion 34*a* of the passive lever 34 engages the engaging projection portion 21*d* of the latch 21. At this time, the engaging pin 34*c* is disposed above the pivoting center of the active lever 33 and therefore the position remains constant and is not displaced. The latch 21 is thus rotated in the counterclockwise direction of FIG. 9, and the second engaging claw 21*c* of the latch 21 and the pole 22 engage each other. The latch 2 is thus brought into the full latched state and the sliding door 4 is held in the completely closed state. Thereafter, the motor 32 is driven in the reverse direction and the active lever 33 returns to the initial state shown in FIG. 8.

Figure 10:
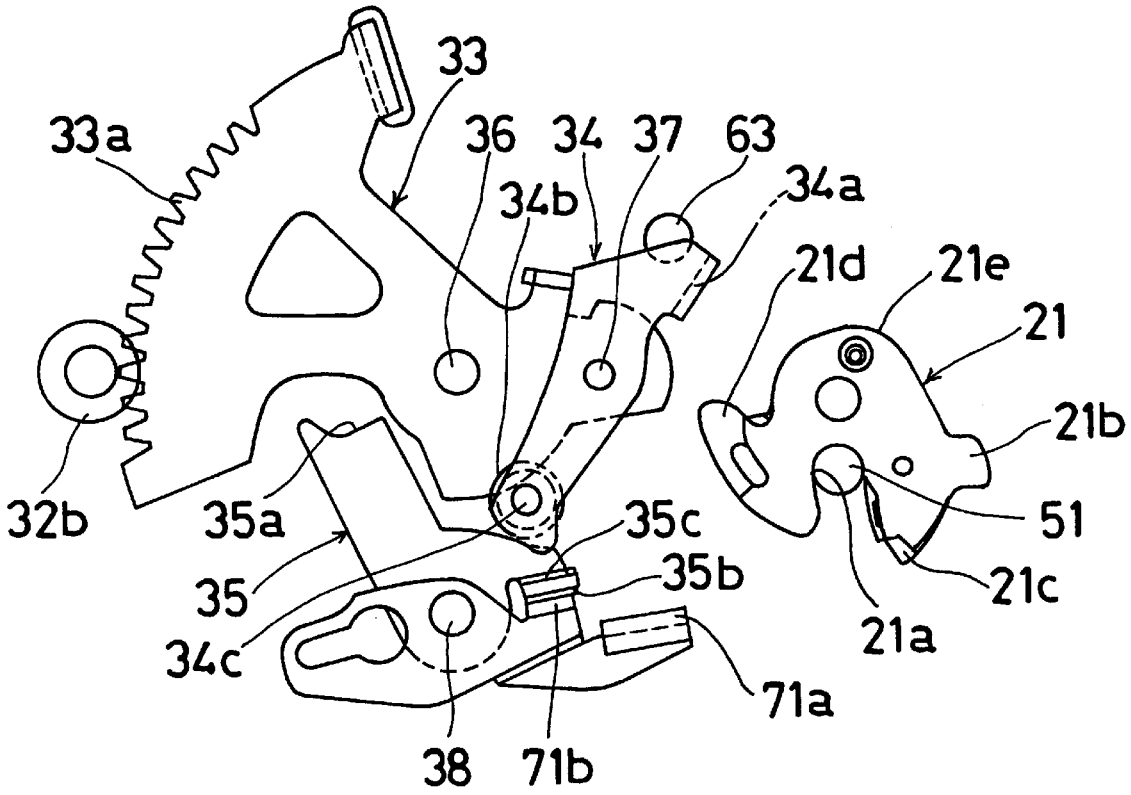
FIG. 10 is a front view of the closing mechanism shown in FIG. 5 illustrating a further operational position of the closing mechanism.
Figure 11:
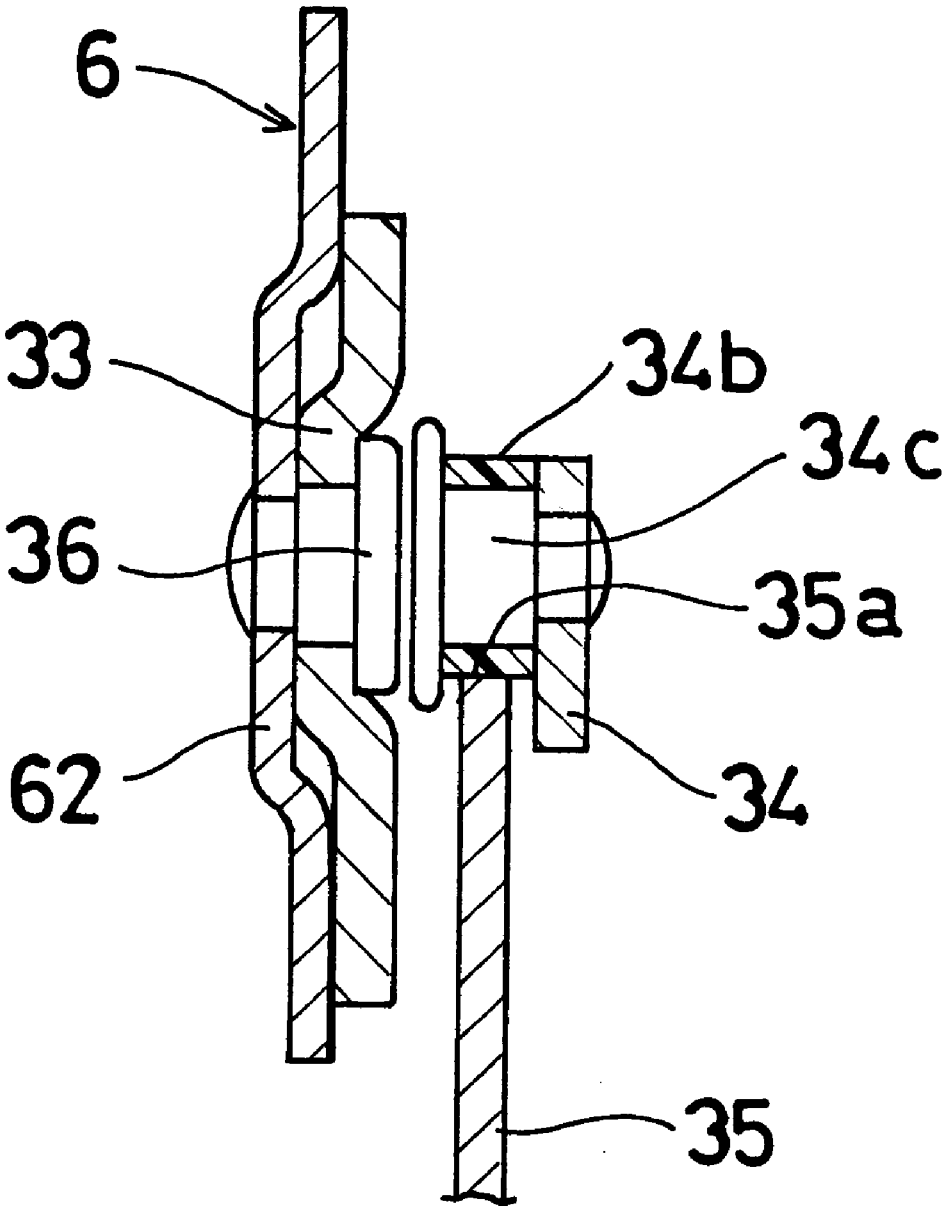
FIG. 11 is a cross-sectional view of the closing mechanism taken along the section line XI—XI in FIG. 9.

When the outside handle 41 is operated in the completely closed state of the sliding door 4, the connecting lever 71 is pivoted in the counterclockwise direction of FIG. 10 via the connecting link 72. The open lever 26 is thus pivoted to release the engagement between the pole 22 and the second engaging claw 21*c* of the latch 21, and so the latch mechanism 2 is brought into the unlatched state. At this time, although by pivoting the connecting lever 71 in the counterclockwise direction of FIG. 10, the cancel lever 35 is also operated to pivot, the predetermined clearance D is set between the engaging face 35*a* of the cancel lever 35 and the engaging pin 34*c*. Thus, no twist is caused in the cancel lever 35 and the cancel lever 35 is smoothly operated to pivot. That is, no load is caused in operating the outside handle 41.

When, in the above-described closing operation, the outside handle 41 is operated as shown in FIG. 10, the connect ing lever 71 is pivoted in the counterclockwise direction of FIG. 10 via the connecting link 72. The cancel lever 35 is thus pivoted in the counterclockwise direction of FIG. 10 against the urging force of the spring 31 by the contact between the engaging arm portion 71*b* of the connecting lever 71 and the contact flange 35*c* of the cancel lever 35, and the engagement between the engaging face 35*a* of the cancel lever 35 and the engaging pin 34*c* of the passive lever 34 is released. The passive lever 34 is pivoted in the counterclockwise direction of FIG. 10 by the urging force of the spring 39 and the engaging arm portion 34*a* of the passive lever 34 is deviated or spaced from the pivoting locus B of the engaging projection portion 21*d* of the latch 21. As a result, the closing operation is canceled. At this time, by pivoting the connecting lever 71 in the counterclockwise direction of FIG. 10, the open lever 26 is also operated to pivot, the engagement between the pole 22 and the first and second claw portions 21*b*, 21*c* of the latch 21 is released, and the latch mechanism 2 is brought into the initial unlatched state.

According to the present invention, the passive lever is pivotally supported relative to the active lever and the pivoting pin installed at the passive lever is engaged with and disengaged from the cancel lever above the pivoting center of the active lever to regulate or permit pivoting of the passive lever relative to the active lever. Therefore, the pivoting pin is always disposed above the pivoting center of the active lever and is not moved, and the lever ratio of the cancel lever can be made always constant. Thus, the operation of the cancel lever does not become heavy or difficult by the operational timings of the cancel lever, and excellent operational performance can be achieved.

Additionally, in accordance with the present invention, the engaging pin is arranged such that the span from the pivoting center of the passive lever to the engaging pin becomes equal to or larger than the span from the pivoting center of the passive lever to the point where the latch mechanism is engaged with the passive lever. Thus, compared with other known apparatus, restriction of the relative pivoting of the passive lever can be carried out by a small force.

Also, in the present invention, the stopper pin is provided for being brought into contact with the passive lever to hold the passive lever such that a predetermined clearance is set between the engaging pin and the cancel lever. Thus, no twist is caused in the cancel lever during the opening operation and excellent operational performance can be provided in the opening operation.

Further, according to the present invention, the engaging projection portion of the latch engaging with the output lever of the closer mechanism is formed on the outer peripheral face of the latch to overlap the U-shaped notches in the base plate. The space occupied by the closing mechanism at the inside of the vehicle door can be reduced and so the space for moving the sliding glass up and down can be easily realized at the inside of the vehicle door without enlarging the thickness of the vehicle door.

The principles, preferred embodiment and mode of operation of the present invention have been described in the foregoing specification. However, the invention which is intended to be protected is not to be construed as limited to the particular embodiment disclosed. Further, the embodiment described herein is to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims be embraced thereby.

What is claimed is:

1. A vehicle door closing apparatus comprising;

a striker mounted on a side of a vehicle body;

a latch mechanism mounted on a side of a vehicle door to hold the vehicle door in a half closed state and a completely closed state by engaging the striker; and a closing mechanism coupled to the latch mechanism to bring the vehicle door in the half closed state into the completely closed state, the closing mechanism including a pivotable active lever connected to a drive source, a passive lever supported on the active lever and engaging the latch mechanism, and a cancel lever connected to an operation device and selectively engaging and disengaging the passive lever above a pivoting center of the active lever for effecting engagement and disengagement between the passive lever and the active lever.

2. The vehicle door closing apparatus according to claim 1, wherein the passive lever is pivotally supported on the active lever and has an engaging pin that is engageable with and disengageable from the cancel lever, the passive lever including an engaging arm portion that is adapted to engage the latch mechanism.

3. The vehicle door closing apparatus according to claim 2, wherein the engaging pin is positioned such that the distance from a pivoting center of the passive lever to the engaging pin is equal to or greater than the distance from the pivoting center of the passive lever to a point at which the latch mechanism and the engaging arm portion of the passive lever engage each other.

4. The vehicle door closing apparatus according to claim 2, including a stopper member for holding the passive lever so that with the stopper member in contact with the passive lever a predetermined clearance exists between the engaging pin and the cancel lever.

5. The vehicle door closing apparatus according to claim 1, wherein the latch mechanism includes a pole for being engaged with and disengaged from the latch, the latch mechanism further including a base plate for rotatably supporting the latch and the pole, the base plate being formed with generally U-shaped notches into which the striker advances, a generally U-shaped groove formed at an outer peripheral surface of the latch and overlapping at least one of the U-shaped notches for being engaged with and disengaged from the striker upon advancement of the striker into the generally U-shaped notches, and an engaging projection portion formed on an outer periphery of the base plate for engaging the passive lever.

6. The vehicle door closing apparatus according to claim 5, wherein the base plate includes a horizontal wall for rotatably supporting the latch and the pole, and a vertical wall extending from an edge of the horizontal wall, the vertical wall supporting the closing mechanism and the engaging projection portion being positioned to be adjacent to the vertical wall.

7. The vehicle door closing apparatus according to claim 1, wherein the passive lever includes an engaging arm portion that is engageable with the latch mechanism.

8. A vehicle door closing apparatus comprising;

a striker mounted on a side of a vehicle body;

a latch mechanism mounted on a side of a vehicle door to hold the vehicle door in a half closed state and a completely closed state through engagement with the striker, said latch mechanism including a latch; and a closing mechanism coupled to the latch mechanism to bring the vehicle door in the half closed state into the completely closed state, the closing mechanism comprising a pivotable active lever connected to a drive source, a movable passive lever supported on the active lever, said passive lever engaging the latch of the latch mechanism to rotate the latch, and a cancel lever connected to an operation device and selectively engaging and disengaging the passive lever above a pivoting center of the active lever for effecting engagement and disengagement between the passive lever and the active lever.

9. The vehicle door closing apparatus according to claim 8, wherein the passive lever is pivotally supported on the active lever and has an engaging pin that is engageable with and disengageable from the cancel lever, the passive lever including an engaging arm portion that is adapted to engage the latch of the latch mechanism.

10. The vehicle door closing apparatus according to claim 9, wherein the engaging pin is positioned such that the distance from a pivoting center of the passive lever to the engaging pin is at least equal to the distance from the pivoting center of the passive lever to a point at which the latch of the latch mechanism and the engaging arm portion of the passive lever engage each other.

11. The vehicle door closing apparatus according to claim 9, including a stopper member for holding the passive lever so that with the stopper member in contact with the passive lever a predetermined clearance exists between the engaging pin and the cancel lever.

12. The vehicle door closing apparatus according to claim 8, wherein the latch mechanism includes a pole engageable with and disengageable from the latch of the latch mechanism, the latch mechanism further including a base plate for rotatably supporting the latch and the pole, the base plate being formed with generally U-shaped notches into which the striker advances, a generally U-shaped groove formed at an outer peripheral surface of the latch and overlapping at least one of the U-shaped notches for being engaged with and disengaged from the striker upon advancement of the striker into the generally U-shaped notches, and an engaging projection portion formed on an outer periphery of the base plate for engaging the passive lever.

13. The vehicle door closing apparatus according to claim 12, wherein the base plate includes a horizontal wall for rotatably supporting the latch and the pole, and a vertical wall extending from an edge of the horizontal wall, the vertical wall supporting the closing mechanism and the engaging projection portion being positioned to be adjacent to the vertical wall.

14. The vehicle door closing apparatus according to claim 8, wherein the passive lever includes an engaging arm portion that is engageable with the latch of the latch mechanism.

* * * * *